US006532618B2

(12) United States Patent
Koch

(10) Patent No.: US 6,532,618 B2
(45) Date of Patent: Mar. 18, 2003

(54) FLOOR MAT WITH INCORPORATED VACUUM SYSTEM

(76) Inventor: Robert Koch, 22 Palisades Ave., Bergenfield, NJ (US) 07621

( * ) Notice: Subject to any disclaimer, the term of this patent is extended or adjusted under 35 U.S.C. 154(b) by 0 days.

(21) Appl. No.: 09/871,800

(22) Filed: Jun. 1, 2001

(65) Prior Publication Data

US 2002/0178528 A1 Dec. 5, 2002

(51) Int. Cl.[7] ..... A47L 5/38
(52) U.S. Cl. ..... 15/310; 15/308; 15/311
(58) Field of Search ..... 15/308, 310, 311

(56) References Cited

U.S. PATENT DOCUMENTS 1,361,068 A * 12/1920 Karro ..... 15/311
3,064,298 A * 11/1962 Jones ..... 15/310
3,165,773 A * 1/1965 Palpacelli ..... 15/310
3,649,994 A * 3/1972 Harris ..... 15/311
3,737,942 A * 6/1973 Casey ..... 15/311
3,786,531 A * 1/1974 Borg ..... 15/310
4,425,677 A * 1/1984 Cox ..... 15/104.92
5,588,175 A * 12/1996 Zahner ..... 15/310
5,870,797 A * 2/1999 Anderson ..... 15/310
5,991,967 A * 11/1999 Williams ..... 15/311
6,067,688 A * 5/2000 West ..... 15/311

* cited by examiner

*Primary Examiner*—Theresa T. Snider
(74) *Attorney, Agent, or Firm*—Goldstein & Lavas, P.C.

(57) ABSTRACT

A floor mat with incorporated vacuum system including a permeable mat portion having an upper surface and a lower surface. The upper surface is defined by a plurality of upwardly extending bristles. A vacuum assembly is coupled with respect to the permeable mat portion. The vacuum assembly includes a pipe circuit disposed below the lower surface of the mat portion. The pipe circuit has a main outlet pipe extending outwardly therefrom. The main outlet pipe has an open outer end disposed beyond the mat portion. The pipe circuit has a plurality of air intakes extending upwardly therefrom in a spaced relationship. The air intakes have open upper ends in contact with the lower surface of the mat portion. The vacuum assembly includes an intake housing positioned adjacently to the mat portion. The intake housing has a hollow interior defining a debris collection chamber. The intake housing receives the open outer end of the main outlet pipe therein. The vacuum assembly includes a suction fan disposed within the intake housing.

6 Claims, 2 Drawing Sheets

FLOOR MAT WITH INCORPORATED VACUUM SYSTEM

BACKGROUND OF THE INVENTION

The present invention relates to a floor mat with incorporated vacuum system and more particularly pertains to allowing dirt that normally accumulates to be instantly consumed.

The use of shoe cleaning devices is known in the prior art. More specifically, shoe cleaning devices heretofore devised and utilized for the purpose of cleaning shoes are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,588,175 to Zahner discloses a device for removing debris from shoes using a vacuum assembly capable of being activated when the user steps on a resilient pad with a micro-switch incorporated. U.S. Pat. No. 5,991,967 to Williams discloses a device for cleaning the soles of shoes using an oscillating brush assembly and a vacuum. U.S. Pat. No. 4,425,677 to Cox discloses a shoe cleaning device using a liquid deodorant.

While these devices fulfill their respective, particular objective and requirements, the aforementioned patents do not describe a floor mat with incorporated vacuum system for allowing dirt that normally accumulates to be instantly consumed.

In this respect, the floor mat with incorporated vacuum system according to the present invention substantially departs from the conventional concepts and designs of the prior art, and in doing so provides an apparatus primarily developed for the purpose of allowing dirt that normally accumulates to be instantly consumed.

Therefore, it can be appreciated that there exists a continuing need for a new and improved floor mat with incorporated vacuum system which can be used for allowing dirt that normally accumulates to be instantly consumed. In this regard, the present invention substantially fulfills this need.

SUMMARY OF THE INVENTION

In the view of the foregoing disadvantages inherent in the known types of shoe cleaning devices now present in the prior art, the present invention provides an improved floor mat with incorporated vacuum system. As such, the general purpose of the present invention, which will be described subsequently in greater detail, is to provide a new and improved floor mat with incorporated vacuum system which has all the advantages of the prior art and none of the disadvantages.

To attain this, the present invention essentially comprises a permeable mat portion having a generally rectangular configuration. The mat portion has an upper surface and a lower surface. The upper surface is defined by a plurality of upwardly extending bristles. A vacuum assembly is coupled with respect to the permeable mat portion. The vacuum assembly includes a rectangularly configured pipe circuit disposed below the lower surface of the mat portion. The pipe circuit has a main outlet pipe extending outwardly therefrom. The main outlet pipe has an open outer end disposed beyond the mat portion. The pipe circuit has a plurality of air intakes extending upwardly therefrom in a spaced relationship. The air intakes have open upper ends in contact with the lower surface of the mat portion. The vacuum assembly includes an intake housing positioned adjacently to the mat portion. The intake housing has a hollow interior defining a debris collection chamber. The intake housing receives the open outer end of the main outlet pipe therein. The intake housing has an air exhaust port. The vacuum assembly includes a labyrinth passageway extending from the open outer end of the main outlet pipe to the air exhaust port. The passageway has a debris filter therein above the debris collection chamber. The vacuum assembly includes a suction fan disposed within the intake housing above the debris filter. The vacuum assembly includes a pressure activation switch in communication with the suction fan. The pressure activation switch is disposed below the mat portion whereby pressure on the mat portion will cause the suction fan to be activated.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved floor mat with incorporated vacuum system which has all the advantages of the prior art shoe cleaning devices and none of the disadvantages.

It is another object of the present invention to provide a new and improved floor mat with incorporated vacuum system which may be easily and efficiently manufactured and marketed.

It is a further object of the present invention to provide a new and improved floor mat with incorporated vacuum system which is of durable and reliable construction.

An even further object of the present invention is to provide a new and improved floor mat with incorporated vacuum system which is susceptible of a low cost of manufacture with regard to both materials and labor, and which accordingly is then susceptible of low prices of sale to the consuming public, thereby making such a floor mat with incorporated vacuum system economically available to the buying public.

Even still another object of the present invention is to provide a new and improved floor mat with incorporated vacuum system for allowing dirt that normally accumulates to be instantly consumed.

Lastly, it is an object of the present invention to provide a new and improved floor mat with incorporated vacuum system including a permeable mat portion having an upper surface and a lower surface. The upper surface is defined by a plurality of upwardly extending bristles. A vacuum assembly is coupled with respect to the permeable mat portion. The vacuum assembly includes a pipe circuit disposed below the lower surface of the mat portion. The pipe circuit has a main outlet pipe extending outwardly therefrom. The main outlet pipe has an open outer end disposed beyond the mat portion. The pipe circuit has a plurality of air intakes extending upwardly therefrom in a spaced relationship. The air intakes have open upper ends in contact with the lower surface of the mat portion. The vacuum assembly includes an intake housing positioned adjacently to the mat portion. The intake housing has a hollow interior defining a debris collection chamber. The intake housing receives the open outer end of the main outlet pipe therein. The vacuum assembly includes a suction fan disposed within the intake housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figures 1, 2:
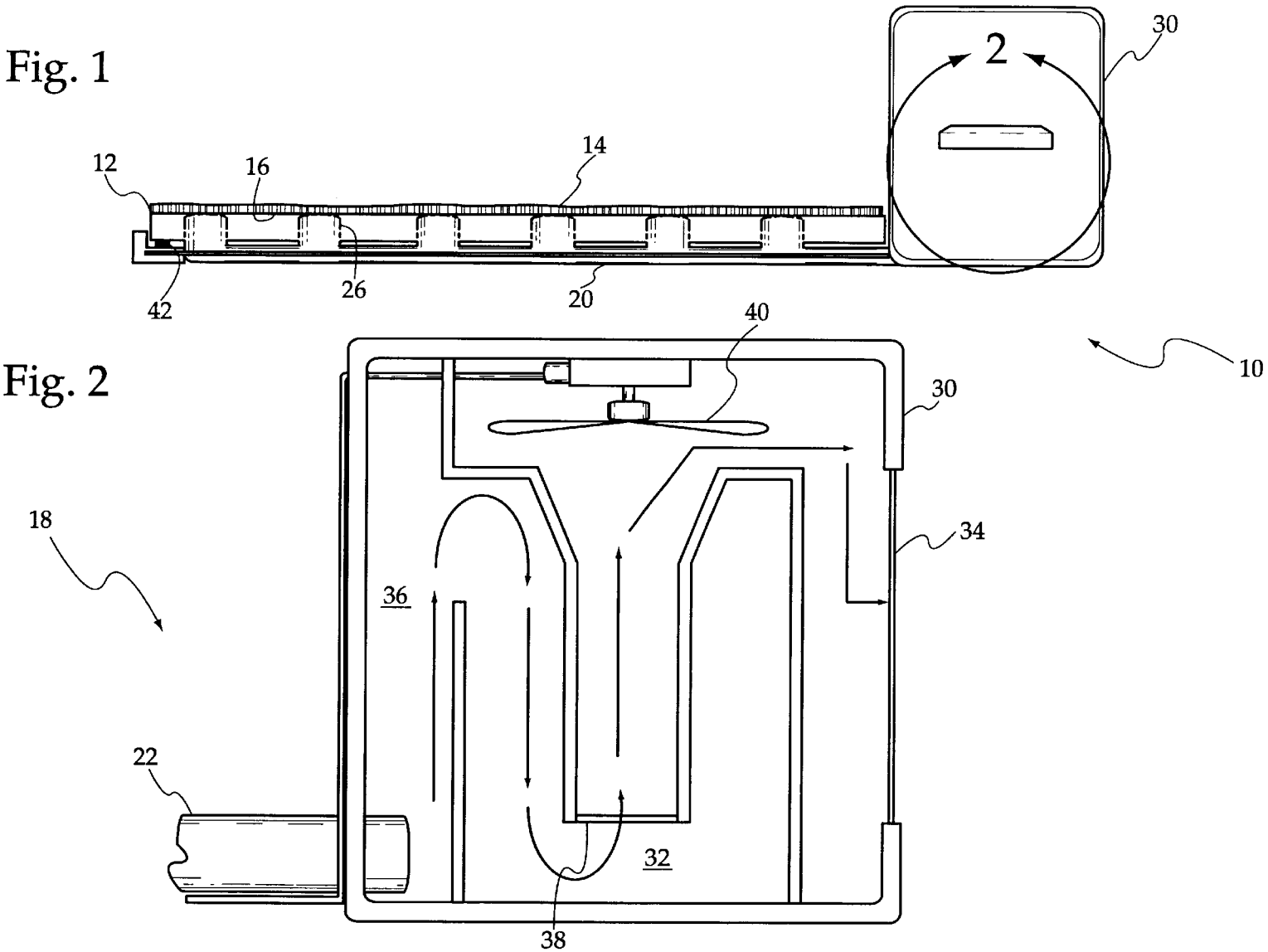
FIG. 1 is a side view of the preferred embodiment of the floor mat with incorporated vacuum system constructed in accordance with the principles of the present invention.
FIG. 2 is a cross-sectional side view of the vacuum portion of the present invention.
Figure 3:
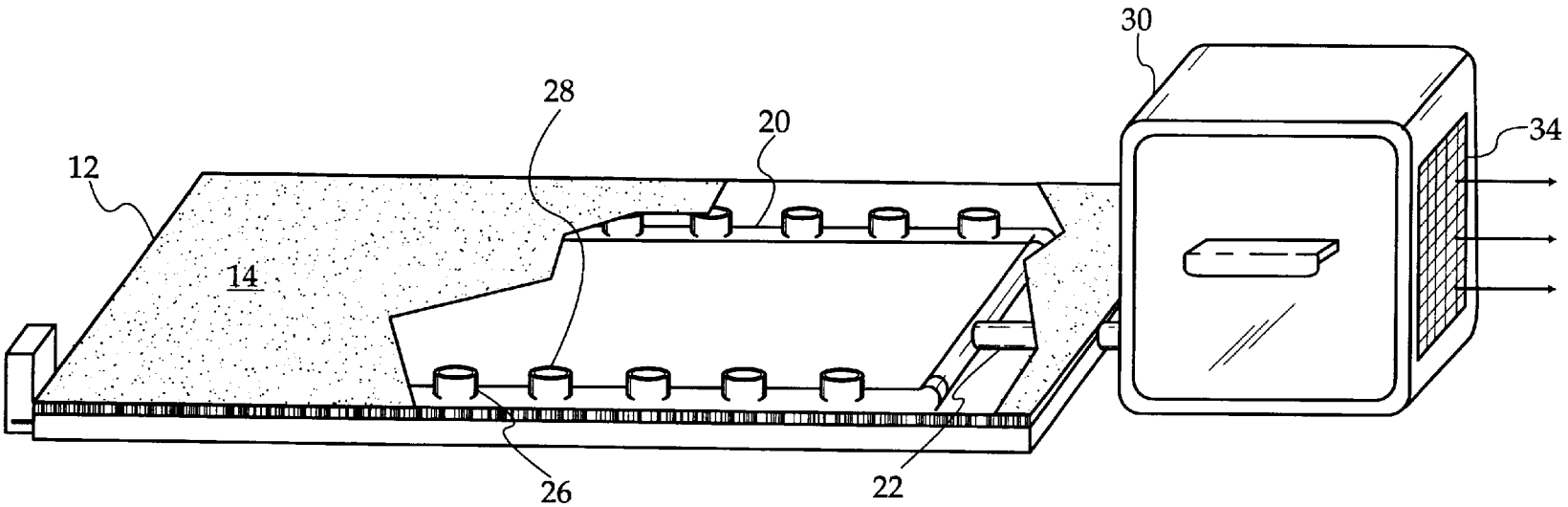
FIG. 3 is a plan perspective view of the present invention.

With reference now to the drawings, and in particular, to FIGS. 1 through 3 thereof, the preferred embodiment of the new and improved floor mat with incorporated vacuum system embodying the principles and concepts of the present invention and generally designated by the reference number 10 will be described.

Specifically, it will be noted in the various Figures that the device relates to a floor mat with incorporated vacuum system for allowing dirt that normally accumulates to be instantly consumed. In its broadest context, the device consists of a permeable mat portion and a vacuum assembly. Such components are individually configured and correlated with respect to each other so as to attain the desired objective.

The permeable mat portion 12 has a generally rectangular configuration. The mat portion 12 has an upper surface 14 and a lower surface 16. The upper surface 14 is defined by a plurality of upwardly extending bristles. The important feature of the mat portion 12 is that it will allow dirt and debris to pass there through.

The vacuum assembly 18 is coupled with respect to the permeable mat portion 12. The vacuum assembly 18 includes a rectangularly configured pipe circuit 20 disposed below the lower surface 16 of the mat portion 12. Note FIGS. 1 and 3. The pipe circuit 20 has a main outlet pipe 22 extending outwardly therefrom. The main outlet pipe 22 has an open outer end 24 disposed beyond the mat portion 12. The pipe circuit 20 has a plurality of air intakes 26 extending upwardly therefrom in a spaced relationship. The air intakes 26 have open upper ends 28 in contact with the lower surface 16 of the mat portion 12. The vacuum assembly 18 includes an intake housing 30 positioned adjacently to the mat portion 12. The intake housing 30 has a hollow interior defining a debris collection chamber 32. The intake housing 30 receives the open outer end 24 of the main outlet pipe 22 therein. Note FIG. 2. The intake housing 30 has an air exhaust port 34. The air exhaust portion 34 will be covered by a removable filter. The vacuum assembly 18 includes a labyrinth passageway 36 extending from the open outer end 24 of the main outlet pipe 22 to the air exhaust port 34. The passageway 36 has a debris filter 38 therein above the debris collection chamber 32. The vacuum assembly 18 includes a suction fan 40 disposed within the intake housing 30 above the debris filter 38. The vacuum assembly 18 includes a pressure activation switch 42 in communication with the suction fan 40. The pressure activation switch 42 is disposed below the mat portion 12 whereby pressure on the mat portion 12 will cause the suction fan 40 to be activated. The suction fan 40 can be activated for a predetermined length of time or, alternately, for the length of time a person remains standing on the mat portion 12. Additionally, the pressure activation switch 42 will be able to connect with a standard AC power source. The intake housing 30 will also be provided with a removable side panel to allow the debris collection chamber 32 to be emptied.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A floor mat with incorporated vacuum system for allowing dirt that normally accumulates thereon to be instantly consumed comprising, in combination:

a permeable mat portion having a generally rectangular configuration, the mat portion having an upper surface and a lower surface, the upper surface being defined by a plurality of upwardly extending bristles; and a vacuum assembly coupled to the permeable mat portion, the vacuum assembly including a rectangularly configured pipe circuit disposed below the lower surface of the mat portion, the pipe circuit having a main outlet pipe extending outwardly therefrom, the main outlet pipe having an open outer end disposed beyond the mat portion, the pipe circuit having a plurality of air intakes extending upwardly therefrom in a spaced relationship, the air intakes having open upper ends in contact with the lower surface of the mat portion, the vacuum assembly including an intake housing positioned adjacent to the mat portion, the intake housing having a hollow interior defining a debris collection chamber, the intake housing receiving the open outer end of the main outlet pipe therein, the intake housing having an air exhaust port, the vacuum assembly including a labyrinth passageway extending from the open outer end of the main outlet pipe to the air exhaust port, the passageway having a debris filter therein above the debris collection chamber, the vacuum assembly including a suction fan disposed within the intake housing above the debris filter, the vacuum assembly including a pressure activation switch in communication with the suction fan, the pressure activation switch being disposed below the mat portion whereby pressure on the mat portion will cause the suction fan to be activated.

2. A floor mat with incorporated vacuum system for allowing dirt that normally accumulates thereon to be instantly consumed comprising, in combination:

a permeable mat portion having an upper surface and a lower surface, the upper surface being defined by a plurality of upwardly extending bristles; and a vacuum assembly coupled to the permeable mat portion, the vacuum assembly including a pipe circuit disposed below the lower surface of the mat portion, the pipe circuit having a main outlet pipe extending outwardly therefrom, the main outlet pipe having an open outer end disposed beyond the mat portion, the pipe circuit having a plurality of air intakes extending upwardly therefrom in a spaced relationship, the air intakes having open upper ends in contact with the lower surface of the mat portion, the vacuum assembly including an intake housing positioned adjacent to the mat portion, the intake housing having a hollow interior defining a debris collection chamber, the intake housing receiving the open outer end of the main outlet pipe therein, the vacuum assembly including a suction fan disposed within the intake housing.

3. The floor mat with incorporated vacuum system as set forth in claim 2, wherein the intake housing has an air exhaust port.

4. The floor mat with incorporated vacuum system as set forth in claim 3, wherein the vacuum assembly includes a labyrinth passageway extending from the open outer end of the main outlet pipe to the air exhaust port.

5. The floor mat with incorporated vacuum system as set forth in claim 4, wherein the passageway has a debris filter therein above the debris collection chamber and below the suction fan.

6. The floor mat with incorporated vacuum system as set forth in claim 2, wherein the vacuum assembly includes a pressure activation switch in communication with the suction fan, the pressure activation switch being disposed below the mat portion whereby pressure on the mat portion will cause the suction fan to be activated.

* * * * *